US005322283A

United States Patent [19]

Ritchie et al.

[11] Patent Number: 5,322,283

[45] Date of Patent: Jun. 21, 1994

[54] ROTARY BALL RECEPTACLE FOR A PINBALL GAME

[75] Inventors: Mark D. Ritchie, Carol Stream; John W. Skalon, Des Plaines, both of Ill.

[73] Assignee: Williams ELectronics Games, Inc., Chicago, Ill.

[21] Appl. No.: 20,767

[22] Filed: Feb. 22, 1993

[51] Int. Cl.[5] ..... A63F 7/30

[52] U.S. Cl. ..... 273/177 C; 273/118 A; 273/118 D; 273/120 A; 273/121 A; 273/127 R

[58] Field of Search ..... 273/118 R, 118 A, 118 D, 273/119 R, 119 A, 120 R, 120 A, 121 R, 121 A, 123 R, 123 A, 127 R, 127 A, 127 B, 127 C, 127 D

[56] References Cited

U.S. PATENT DOCUMENTS

| | | | |
|---|---|---|---|
| 3,108,810 | 10/1963 | Wiley, Jr. | 273/120 R |
| 3,592,471 | 7/1971 | Swimmer et al. | 273/120 R |
| 4,395,041 | 7/1983 | Goldfarb et al. | 273/119 A |
| 4,548,408 | 10/1985 | Clark . | |
| 5,120,059 | 6/1992 | Oursler | 273/118 A X |
| 5,226,653 | 7/1993 | Bil | 273/127 R X |

*Primary Examiner*—Vincent Millin
*Assistant Examiner*—Raleigh W. Chiu
*Attorney, Agent, or Firm*—Rockey, Rifkin and Ryther

[57] ABSTRACT

The play feature of the invention consists of a rotary wheel having a plurality of ball receiving sockets located therein. The wheel is rotated such that an empty socket is disposed in a ball receiving position. During the course of play, the game player can direct a ball into the socket where it is retained. The wheel is then rotated to expose another empty socket into which a player can direct a second ball. Once all of the sockets are filled with balls, the game's microprocessor will rotate the wheel to return the balls to the playfield for multiple ball play. The wheel is rotated by an electric motor that is controlled by optical sensors.

15 Claims, 4 Drawing Sheets

ROTARY BALL RECEPTACLE FOR A PINBALL GAME

BACKGROUND OF THE INVENTION

The invention relates, generally, to pinball games and, more particularly, to an improved play feature for such games.

Pinball games typically include an inclined playfield supporting a rolling ball and a plurality of play features. The game player controls flippers mounted on the playfield to direct the pinball at selected play features thereby scoring points and generating game features.

In the typical pinball game, a single pinball is used on the playfield at a time with the game player controlling that single pinball to create game action. Recently pinball games have been developed in which multiple pinballs are discharged onto the playfield simultaneously such that the game player must attempt to control the action of multiple balls. As will be apparent, the use of multiple balls greatly increases the difficulty and excitement of game play and enhances the appeal of the game to potential players.

In order to create multiple ball play, mechanisms are provided on the playfield that retain the extra ball or balls until the game player achieves a predetermined game objective, for example, attaining a particular score or striking a particular target or series of targets. When the game objective is achieved the game's microprocessor activates the ball retaining mechanism to put the extra ball in play. Typically these mechanisms consisted of relatively simple ball poppers.

While such a mechanism accomplishes multiple ball play, it is desirable for manufacturers to continuously modify such play features to maintain player interest. Thus, an improved multiple ball mechanism is desired.

SUMMARY OF THE INVENTION

The play feature of the invention consists of a rotary wheel having a plurality of ball receiving sockets located therein. The wheel is rotated such that an empty socket is disposed in a ball receiving position. During the course of play, the game player can direct a ball into the socket where it is retained. The wheel is then rotated to expose another empty socket into which a player can direct a second ball. Once all of the sockets are filled with balls, the game's microprocessor will rotate the wheel to return the balls to the playfield for multiple ball play. The wheel is rotated by an electric motor that is controlled by optical sensors.

DETAILED DESCRIPTION OF THE INVENTION

Figure 1:
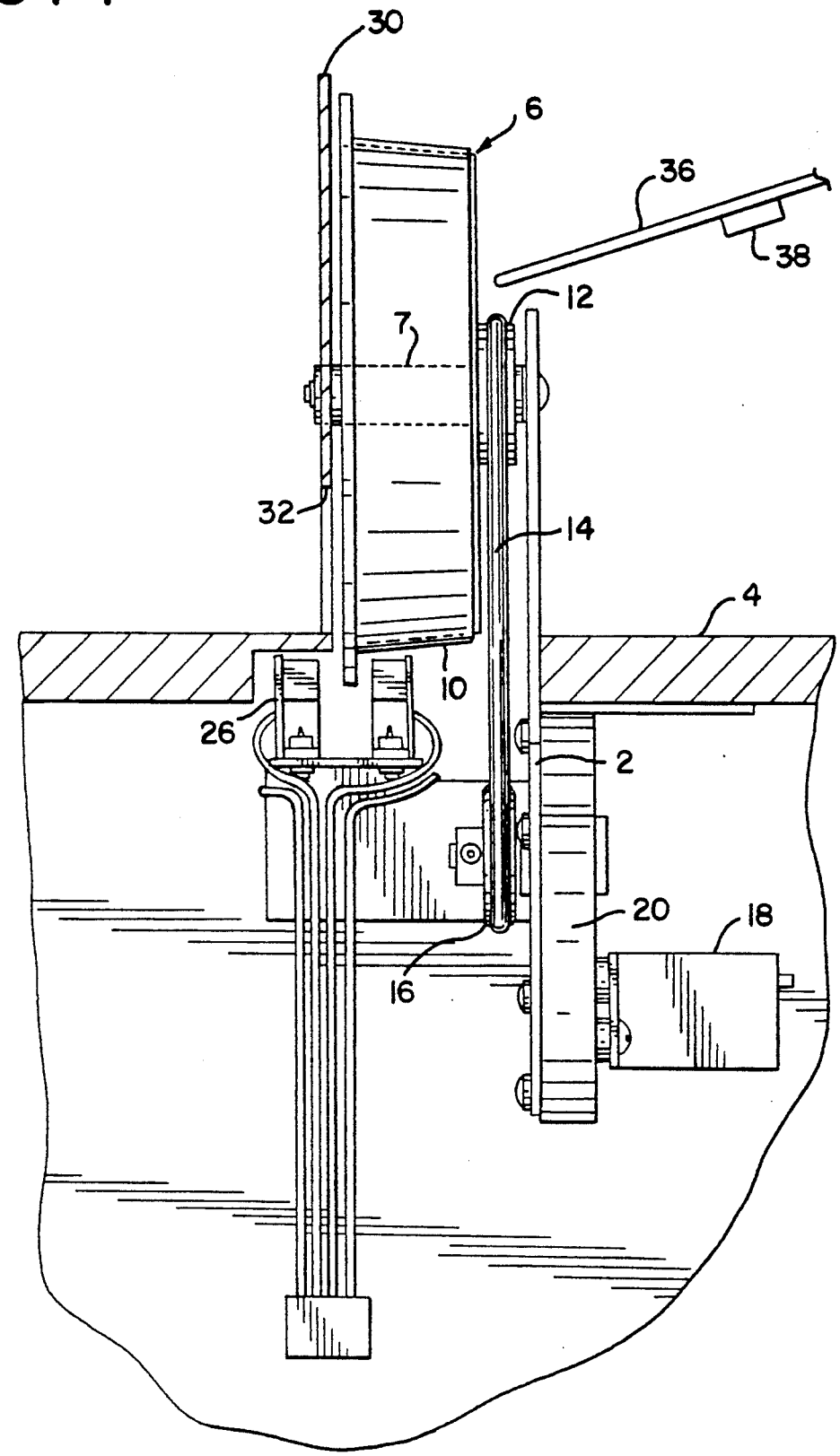
FIG. 1 is a side view of the play feature of the invention.
Figure 2:
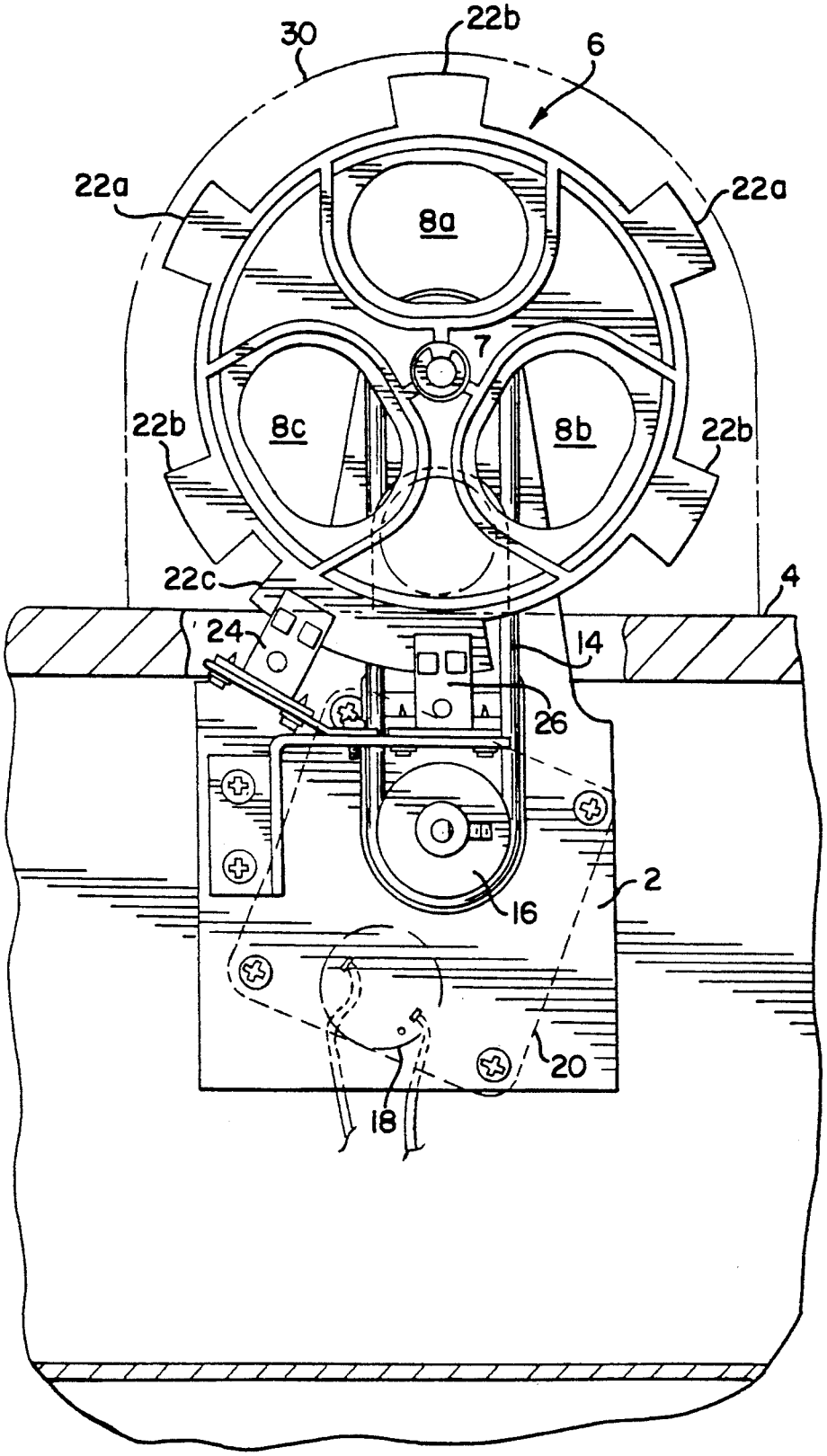
FIG. 2 is a front view of the play feature of the invention.

Referring more particularly to FIGS. 1 and 2, the play feature of the invention includes a support bracket 2 mounted to the underside of a playfield 4. A wheel 6 is mounted on bracket 2 for rotary motion on axle 7. Wheel 6 includes a plurality of ball receptacles 8*a*, 8*b* and 8*c* for receiving a pinball. In the illustrated embodiment three such receptacles are provided. The wall 10 of wheel 6 is angled relative to the horizontal such that a ball located in one of receptacles 8 will tend to roll from right to left as viewed in FIG. 1 under the force of gravity.

Integrally formed on wheel 6 is a pulley 12 that receives a transmission member 14. Transmission member 14 is also reaved over pulley 16 that is operatively connected to electric motor 18 via gear box 20. As a result, the driving of motor 18 will cause the rotation of wheel 6. In the preferred embodiment, transmission member 14 consists of an elastic belt that frictionally engages pulleys 12 and 16 although any suitable transmission mechanism can be used.

Also formed integrally with wheel 6 are a plurality opto-interrupters 22*a*, 22*b* and 22*c*. Opto-interrupters cooperate with optical switches 24 and 26 to provide a signal to the game's microprocessor indicative of the relative rotational position of the wheel. Specifically, opto-interrupters 22*a* indicate ball discharge positions and opto-interrupters 22*b* indicate ball receiving positions as will hereinafter be described. Opto-interrupter 22*c* is wide enough to interrupt both switches as shown in FIG. 1 and represents the "home" or start-up position and is the position of the wheel when game play starts.

Figure 3:
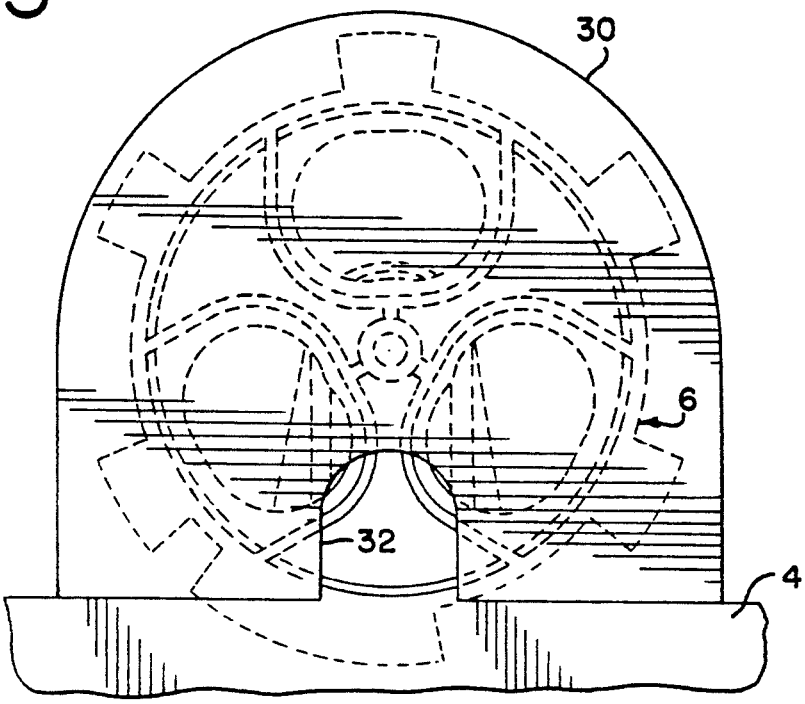
FIG. 3 is a partial front view of the play feature of the invention.

A cover plate 30 is mounted closely adjacent the front face of wheel 6 and is provided with a single aperture 32. The aperture 32 is located in plate 30 such that it can be aligned with one of receptacles 8*a*, 8*b* or 8*c*. When so aligned the ball will roll from the receptacle onto the playfield due to the incline of wall 10 as previously described. The plate 30 will otherwise retain the balls in the receptacles. It should be noted that plate 30 has been shown in phantom line in FIG. 2 for clarity. A front view of the plate is shown in FIG. 3.

A ramp 36 or other similar ball guide is provided to deliver the ball to wheel 6. The ramp 36 is provided with a switch 38, such as an optical sensor, that delivers a signal to the game's microprocessor informing the microprocessor that a ball has entered the wheel. The microprocessor actuates motor 18 to rotate wheel 6 until the next empty receptacle is adjacent ramp 36 as indicated by optical switches 24 and 26.

A preferred operation of the play feature is as follows. The play of the game begins with wheel 6 in the "home" position as illustrated in FIG. 2. All of the receptacles are empty and receptacle 8*a* is positioned adjacent ramp 36 in position to receive a ball.

Should the game player direct a ball onto ramp 36, the ball will close switch 38 as it enters receptacle 8*a*. Switch 38 will deliver a signal to the game's microprocessor indicating the presence of a ball in receptacle 8*a*. In response to that signal, the microprocessor will initiate motor 18 thereby to rotate wheel 6 until the optical switches 26 and 28 signal microprocessor to stop motor 18. The opto-interrupters are arranged such that motor 18 will be stopped when opto-interrupter 22*a* opens switch 26 and receptacle 8*b* is adjacent ramp 36 in position to receive a ball. This process will be repeated until the player fills all of the receptacles.

It should be noted that, receptacle 8*a* having a ball therein will pass by aperture 32 as receptacle 8*c* is positioned adjacent ramp 36. The aperture 32 is dimensioned and the wheel 6 is rotated at such a speed that the ball will not fall out of aperture 32 as the ball is moved passed the aperture.

Once all of the receptacles are filled, as determined by the microprocessor based on the accumulated signals from the game switches, the microprocessor will index the wheel 6 in the opposite direction stopping the wheel when opto-interrupters 22*b* open switch 26 and each receptacle 8 is aligned with aperture 32. As the wheel stops at each discharge position, the balls will fall from the receptacle aligned with aperture 32 and will be discharged onto the playfield resulting in multiple ball play.

The wheel can be directed to discharge the balls when any number of receptacles are filled or after the game player achieves other game objectives. Moreover, the wheel can be spun by motor 16, independent of loading and discharging the balls, to provide entertaining visual effects. Finally, ramp 36 can be replaced by any suitable loading mechanism and an additional play feature can be located at the discharge location if desired.

Figure 4:
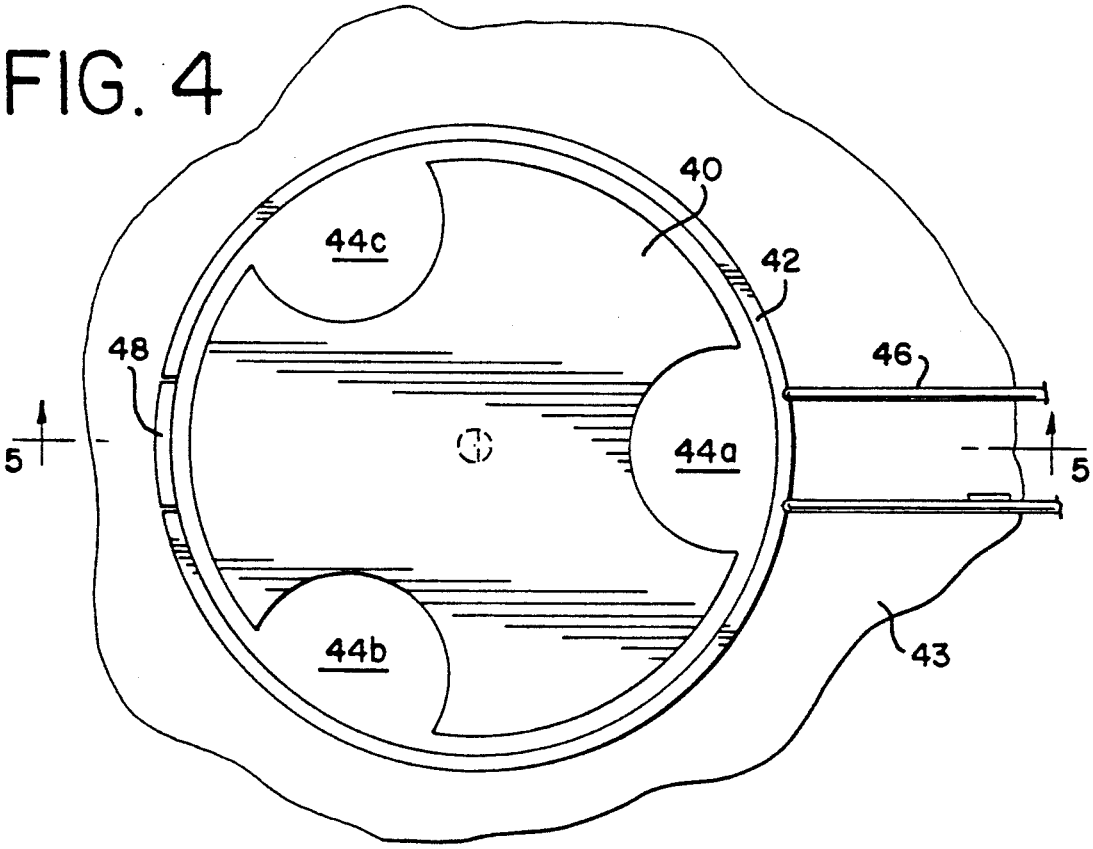
FIG. 4 is a top view of an alternate embodiment of the play feature of the invention.
Figure 5:
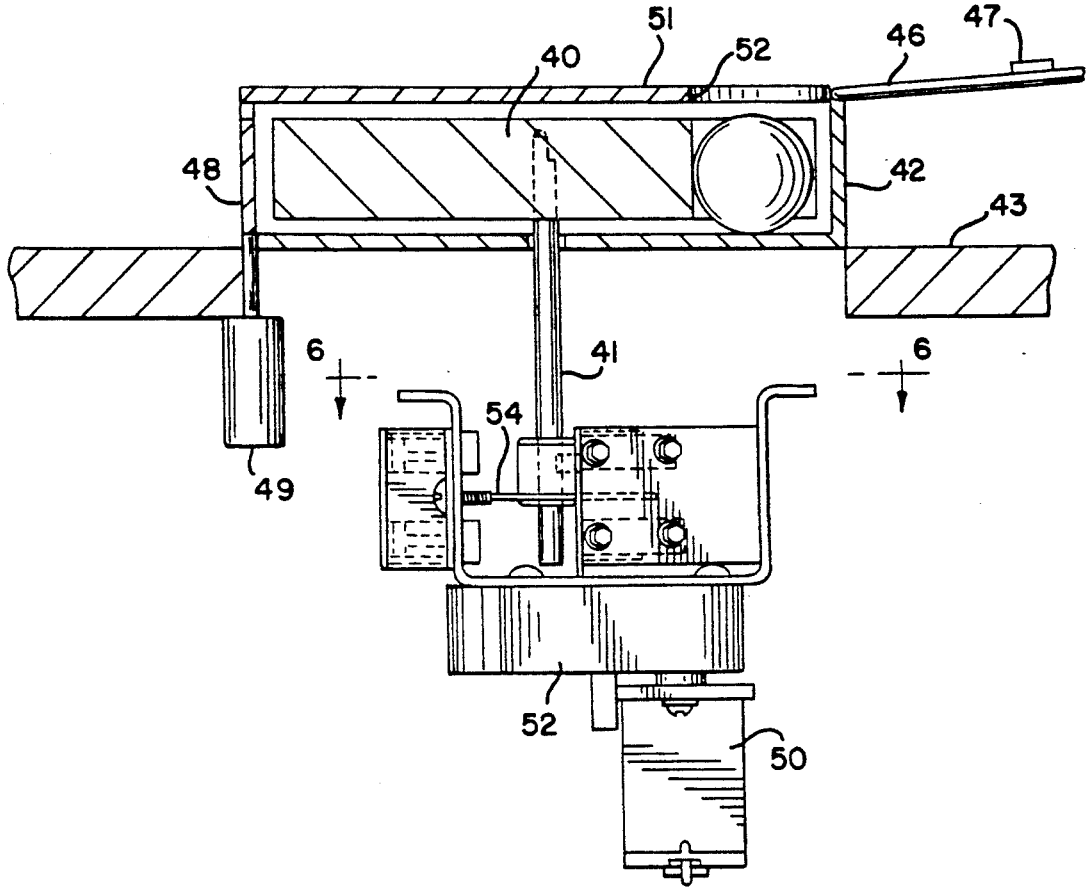
FIG. 5 is a partial section view of the play feature shown in FIG. 4.
Figure 6:
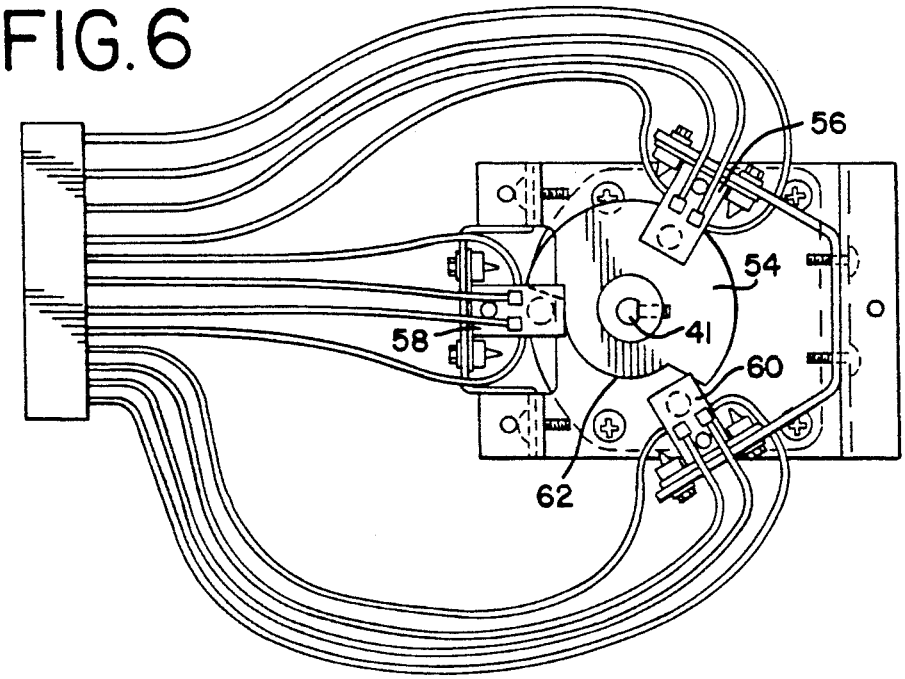
FIG. 6 is a section view taken along line 6—6 of FIG. 5.

An alternate embodiment of the invention is shown in FIGS. 4, 5 and 6 and is similar to the embodiment of FIGS. 1 through 3 except that the device is disposed parallel to the playfield. Specifically the wheel 6 is replaced by rotating wheel 40, the axle 41 on which wheel 40 rotates being arranged perpendicular to the playfield 43. Wheel 40 is disposed in cup 42 to define ball receptacles 44*a*, 44*b* and 44*c* which receive pinballs delivered from above by ramp 46 having an optical sensor 47. A movable gate 48 is located in cup 42 such that when the gate is raised the balls roll out of cup 42 and ar discharged onto the playfield. The gate can be raised by a solenoid 49 or other suitable drive. A cover plate 51 can be provided over cup 42 having an aperture 52 adjacent ramp 46 for allowing the balls to fall into receptacles 44*a*–44*c*.

The drive and control mechanisms are similar to those described in reference to FIG. 1 through 3. Specifically, a motor 50 is connected to axle 41 via gear reducer 52. An opto-interrupter plate 54 is mounted to axle 41 so as to cooperate with optical switches 56, 58 and 60 as best shown in FIG. 6. Plate 54 is provided with a cut-out portion 62 that cooperates with the optical switches to allow the microprocessor to determine the position of wheel 40 in a manner similar to the embodiment described in FIGS. 1–5.

While the play feature of the invention has been described in some detail with respect to the drawings, it will be appreciated that numerous changes in the details and construction of the device can be made without departing from the spirit and scope of the invention.

What is claimed is:

1. A play feature for a pinball game having an inclined playfield supporting a plurality of balls therein, comprising:

(a) means for receiving a plurality of balls consisting of a plurality of ball receptacles;

(b) means for selectively moving said means for receiving and means for determining the position of said means for receiving to control the means for selectively moving to locate a first one of said receptacles in a position where it is accessible by a first ball;

(c) means for determining the presence of a ball in said first receptacle and for generating a signal in response thereto;

(d) means for actuating said means for moving in response to said signal, said means for determining the position of said means for receiving stopping said means for moving when a second one of said receptacles is in a position where it is accessible by a second ball while the first ball is retained in the first one of said receptacles; and (e) said means for receiving retaining said first ball and said second ball simultaneously and means for discharging the first and second balls from said means for receiving onto said playfield whereby multiple ball play occurs.

2. The play feature according to claim 1, wherein the means for receiving consists of a rotary wheel defining said receptacle.

3. The play feature according to claim 1, wherein the means for selectively moving includes an electric motor.

4. The play feature according to claim 1, further including a means for delivering a ball to said receptacle, wherein the means for determining the presence of a ball consists of a sensor associated with said means for delivering for generating said signal.

5. The play feature according to claim 4, wherein the means for delivering includes a ramp.

6. The play feature according to claim 1, wherein the means for actuating consists of a microprocessor for actuating said means for selectively moving in response to said means for determining the position of the means for receiving.

7. A play feature for a pinball game having an inclined playfield supporting a rolling ball and a plurality of other play features, comprising:

(a) a wheel mounted for rotary motion relative to said playfield and having a plurality of ball receptacles formed therein;

(b) means for selectively rotating said wheel;

(c) means for determining the position of said wheel to control the means for selectively rotating to sequentially align said ball receptacles with a first position where a ball can enter each of said ball receptacles and a second position where the balls can be discharged from said ball receptacles;

(d) means for delivering a ball to said receiving means when said receiving means is in said first position and means for determining that a ball has been delivered and for generating a signal in response thereto; and (e) means for discharging the balls from said ball receptacles.

8. The play feature according to claim 7, wherein said wheel is mounted with its axis of rotation parallel to the playfield.

9. The play feature according to claim 7, further including means for retaining said balls in said ball receptacles.

10. The play feature according to claim 7, wherein said wheel is mounted with its axis of rotation perpendicular to the playfield.

11. The play feature according to claim 7, wherein said means for discharging includes a movable gate.

12. The play feature according to claim 7, wherein the means for discharging includes a plate for retaining said balls in said ball receptacles, said plate having an aperture for discharging said balls.

13. The play feature according to claim 7, wherein said means for rotating consists of motor operatively connected to the wheel.

14. A play feature for a pinball game having an inclined playfield supporting a rolling ball and a plurality of other play features, comprising:

(a) a wheel mounted for rotary motion relative to said playfield and having a plurality of ball receptacles formed therein, the axis of rotation of said wheel being disposed perpendicular to the playfield;

(b) means for rotating said wheel to sequentially align said ball receptacle with a first position where a ball can enter each of said ball receptacles and a second position where the balls can be discharged from said ball receptacles;

(c) means for delivering a ball to said receiving means when said receiving means is in said first position and means for determining that a ball has been delivered and for generating a signal in response thereto; and (d) means for discharging the balls from said ball receptacles.

15. A play feature for a pinball game having an inclined playfield and a plurality of balls, comprising:

(a) ball retaining means mounted for movement relative to said playfield including a plurality of receptacles, one of said receptacles being positioned at a first location;

(b) means for delivering a first ball to the one of said receptacles when positioned at the first location;

(c) means for detecting the entry of a first ball from said means for delivering to said one of said receptacles and for generating a first signal in response thereto;

(d) means for selectively moving said ball retaining means, said means for selectively moving being activated upon receipt of said first signal;

(e) means for determining the position of said ball retaining means and for generating a second signal indicative of that position, said means for selectively moving being deactivated upon receipt of said second signal when said ball retaining means is positioned with another of said receptacles positioned to receive a second ball from said means for delivering; and (f) means or discharging the balls from said ball receptacles.

* * * * *